US005291729A

United States Patent [19]

Badiali et al.

[11] Patent Number: 5,291,729

[45] Date of Patent: Mar. 8, 1994

[54] METHOD FOR PNEUMATIC THREADING IN A TWISTER WITH A DOUBLE HOLLOW MANDREL SPINDLE

[75] Inventors: Roberto Badiali, Pordenone; Vittorio Colussi, San Martino Colle Umberto; Gian P. Canova, Pordenone, all of Italy

[73] Assignee: Savio S.p.A., Pordenone, Italy

[21] Appl. No.: 919,012

[22] Filed: Jul. 23, 1992

[30] Foreign Application Priority Data

Aug. 2, 1991 [IT] Italy ..... MI91 A 002197

[51] Int. Cl.[5] ..... D01H 9/18

[52] U.S. Cl. ..... 57/279; 57/58.52; 57/58.83; 57/281

[58] Field of Search ..... 57/261, 279, 58.49, 57/58.52, 58.83, 58.86, 281

[56] References Cited

U.S. PATENT DOCUMENTS

| | | | |
|---|---|---|---|
| 3,029,587 | 4/1962 | Kresslein | 57/58.52 |
| 3,119,224 | 1/1964 | Kocks | 57/58.83 |
| 3,146,573 | 9/1964 | Jones et al. | 57/279 X |
| 3,636,698 | 1/1972 | Nakahara et al. | 57/156 |
| 3,648,449 | 3/1972 | Greive | 57/58.83 |
| 4,047,372 | 9/1977 | Horstmann et al. | 57/34 R |
| 4,067,180 | 1/1978 | Bleeck | 57/58.52 |
| 4,118,919 | 10/1978 | Marbacher | 57/34 R |
| 4,120,142 | 10/1978 | Franzen | 57/58.83 X |
| 4,164,115 | 8/1979 | Franzen | 57/279 |
| 4,199,929 | 4/1980 | Vessella | 57/279 |
| 4,287,712 | 9/1981 | Franzen | 57/279 |
| 4,355,500 | 10/1982 | Yanobu et al. | 57/279 |
| 4,439,979 | 4/1984 | Winkelmann | 57/58.52 X |
| 4,998,405 | 3/1991 | Frentzel-Beyme | 57/279 |
| 5,220,777 | 6/1993 | Badiali et al. | 57/279 |

FOREIGN PATENT DOCUMENTS

| | | | |
|---|---|---|---|
| 0051547 | 5/1982 | European Pat. Off. . | |
| 0383960 | 8/1990 | European Pat. Off. . | |
| 0417850 | 3/1991 | European Pat. Off. . | |
| 1146790 | 4/1963 | Fed. Rep. of Germany | 57/58.49 |
| 2544456 | 3/1977 | Fed. Rep. of Germany . | |
| 2367692 | 5/1978 | France . | |
| 3-372392 | 11/1991 | Japan | 57/58.52 |

*Primary Examiner*—Daniel P. Stodola
*Assistant Examiner*—William Stryjewski
*Attorney, Agent, or Firm*—Shea & Gould

[57] ABSTRACT

A method for pneumatic threading in a two-for-one twisting spindle having a double hollow mandrel. The method comprising seizing the initial portion of wound yarn from a bobbin positioned on the lower hollow mandrel in the spindle basket and feeding a sufficient length of it through the upper hollow mandrel to enable it to be then placed alongside the initial wound yarn portion unwound from the bobbin mounted on the upper hollow mandrel. The two initial yarn portions are then held jointly and rested on the mouth of the upper hollow mandrel, on which a head connected to a compressed air source is placed and pressed, in order to achieve pneumatic yarn threading.

1 Claim, 7 Drawing Sheets

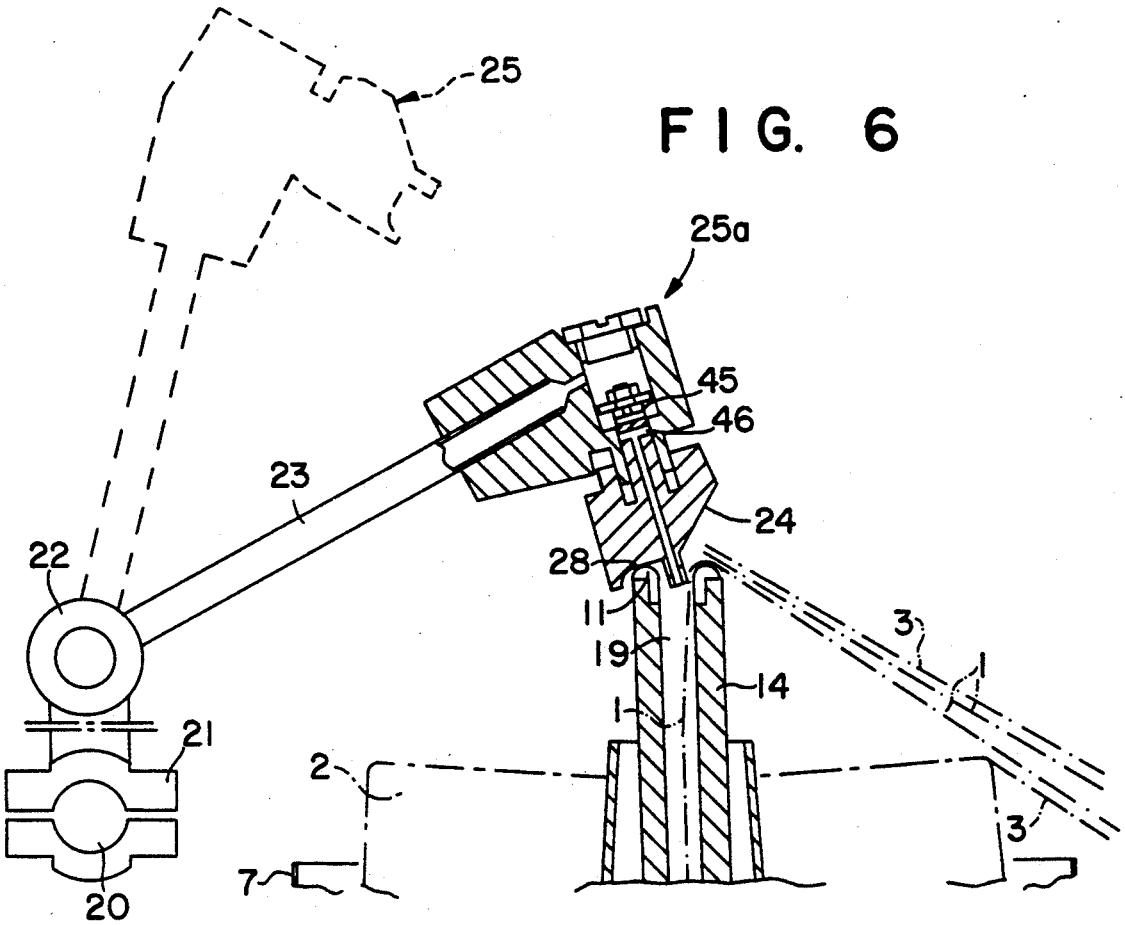
FIG. 6
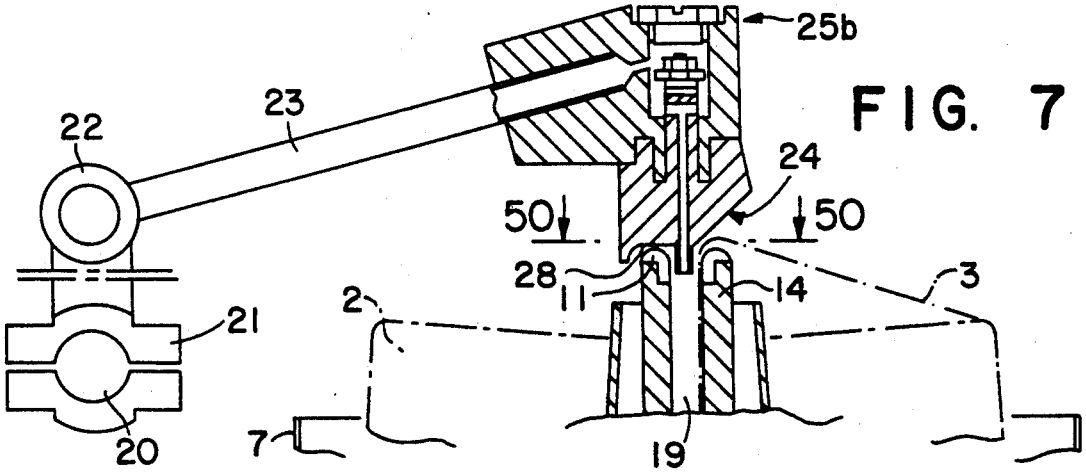
FIG. 7
FIG. 8
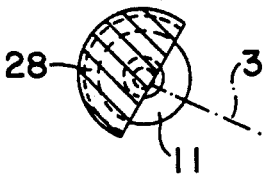

METHOD FOR PNEUMATIC THREADING IN A TWISTER WITH A DOUBLE HOLLOW MANDREL SPINDLE

BACKGROUND OF THE INVENTION

1. Field of the Invention

This invention relates to an improved method for pneumatic threading in a two-for-one twister using a spindle of the double hollow mandrel type.

The invention relates particularly to a two-for-one twisting spindle in which the two yarn bobbins are each mounted on their own hollow mandrel with the yarns unwinding upwards, each yarn unwinding from its own bobbin to directly enter its own hollow mandrel without being conveyed, during its travel, into the space surrounding the other bobbin, all as described and claimed in European Pat.Appln.public. No. 0 417 850 in the name of the present applicant.

2 Description of the Related Art

The yarn braking device, which has long been known (two expansion half-capsules) is located in that portion of the central duct comprising the stationary part of the lower mandrel of the twisting spindle. Both yarns to be twisted together to form the twisted yarn pass through said lower hollow mandrel. Said yarns can be of any composition or structure, and will be known in the ensuing description and claims simply as yarns or twisted yarns, the terms being used interchangeably and including all filaments or filament assemblies or fibers, both natural and artificial. In two-for-one twisting, various types of spindles are known, and it is also known that threading the yarn through the central bore of the hollow mandrel is always a problem, as the operation is difficult and laborious. Numerous methods for simplifying this operation have been studied for the various types of twisting spindles. The present applicant has also filed various patent applications on this subject. In this respect, in the case of two-for-one twisters with a single central hollow mandrel automatic pneumatic threading is already well known, in contrast to spindles with a split central mandrel, in which replacing the empty bobbins with full bobbins, or re-starting the twisting process after an interruption for yarn breakage currently involves very costly and laborious operations of poor reliability. The applicant has therefore evolved and tried an improved method of extreme reliability for pneumatic threading in a spindle comprising a double central hollow mandrel for twisting together two yarns unwound from two overlying feed bobbins.

The improved method of the present invention has the following essential advantages:

it enables a two-for-one twisting spindle with a split central hollow mandrel to benefit from a method providing extremely reliable pneumatic threading each time the twisting process is to be restarted;

it allows rational automation of costly low-reliability operations, leading to a twisted yarn at lower operating cost;

it allows rapid and simple bobbin replacement.

SUMMARY OF THE INVENTION

These and further advantages are all obtained by the present invention, which provides a method for pneumatic threading in a two-for-one twister comprising a spindle of double hollow mandrel type in which the two yarn feed bobbins are located coaxially one above the other in the mandrel basket, each bobbin being mounted on its own hollow mandrel with its yarn unwinding upwards and each yarn directly entering the hollow mandrel of its own bobbin without being conveyed during its travel into the space surrounding the other bobbin, said method comprising the following operating stages:

seizing the initial portion of wound yarn from a feed bobbin positioned on the lower hollow mandrel in the spindle basket, and unwinding it as far as the outside of the winding basket in order to rest it in a transverse position on a compressed air jet injector fixed rigidly to the front frame of the twisting spindles;

resting a feed bobbin, already mounted on the upper hollow mandrel, on said compressed air jet injector on which the yarn end of the bobbin mounted on the lower hollow mandrel remains transversely resting;

pressing the upper hollow mandrel with a downward thrust so that it makes contact with and presses downwards the opening element of the injector nozzle, with the result that the compressed air stream drags the yarn end of the bobbin mounted on the lower hollow mandrel upwards through the central bore of the upper hollow mandrel until it emerges by a sufficient length from the mouth of said upper hollow mandrel;

seizing the initial portion of wound yarn from the bobbin mounted on the upper hollow mandrel and unwinding it by a sufficient length to bring it into contact with the end of the yarn leaving said upper hollow mandrel;

inserting the bobbin mounted on the upper hollow mandrel into the spindle basket in a position vertically above the underlying bobbin;

resting the two jointly retained initial yarn portions pertaining to the two feed bobbins on the mouth of the central bore of the upper hollow mandrel;

bringing up to the mouth of the central bore of the upper hollow mandrel a head connected to a compressed air source;

pressing said head against the underlying upper hollow mandrel to move this latter downwards so that its bush-shaped end part makes contact with and then pushes downwards the sleeve which is rigid with the lower support seat for the expansion yarn braking device, to enable this latter device to move sideways and expose the central bore of the lower hollow mandrel;

injecting compressed air through an injection nozzle, the air jet from which drags the initial yarn portions of the two bobbins in a downward direction through the central bores of the two coaxial hollow mandrels, so that they pass through the accumulator disc and are conveyed to the upper edge of the basket of the twisting spindle, where they are seized to commence the known two-for-one twisting operation.

BRIEF DESCRIPTION OF THE DRAWINGS

With reference to the aforesaid, the accompanying drawings show a preferred embodiment which however is not binding or limiting in terms of the relative positions of the components, and the consequent simplifications which may derive therefrom.

Said embodiment is described hereinafter in relation to the various operating stages of the method, with reference to the accompanying figures, in which:

FIG. 6 is an enlarged schematic axial section through the upper part of FIG. 5, showing the contact region between the lower surface of the head of the compressed air jet injector and the surface of the mouth of the upper hollow mandrel;

FIG. 7 is an enlarged schematic axial section through the upper part of FIG. 5, representing the moment in which the compressed air injection head has pushed the underlying upper hollow mandrel downwards and has automatically activated, on termination of its pushing action, its injection nozzle for the compressed air jet which drags the initial yarn portions of the two bobbins through the central bores of the two overlying hollow mandrels;

FIG. 8 is a schematic section on the line 50—50 of FIG. 7, this figure showing the circular mouth of the central bore of the upper hollow mandrel released from contact with the lower thrust surface of the compressed air jet injection head, the initial yarn portions jointly retained by the operator being conveyed across said circular mouth;

DESCRIPTION OF THE PREFERRED EMBODIMENT

Figure 1:
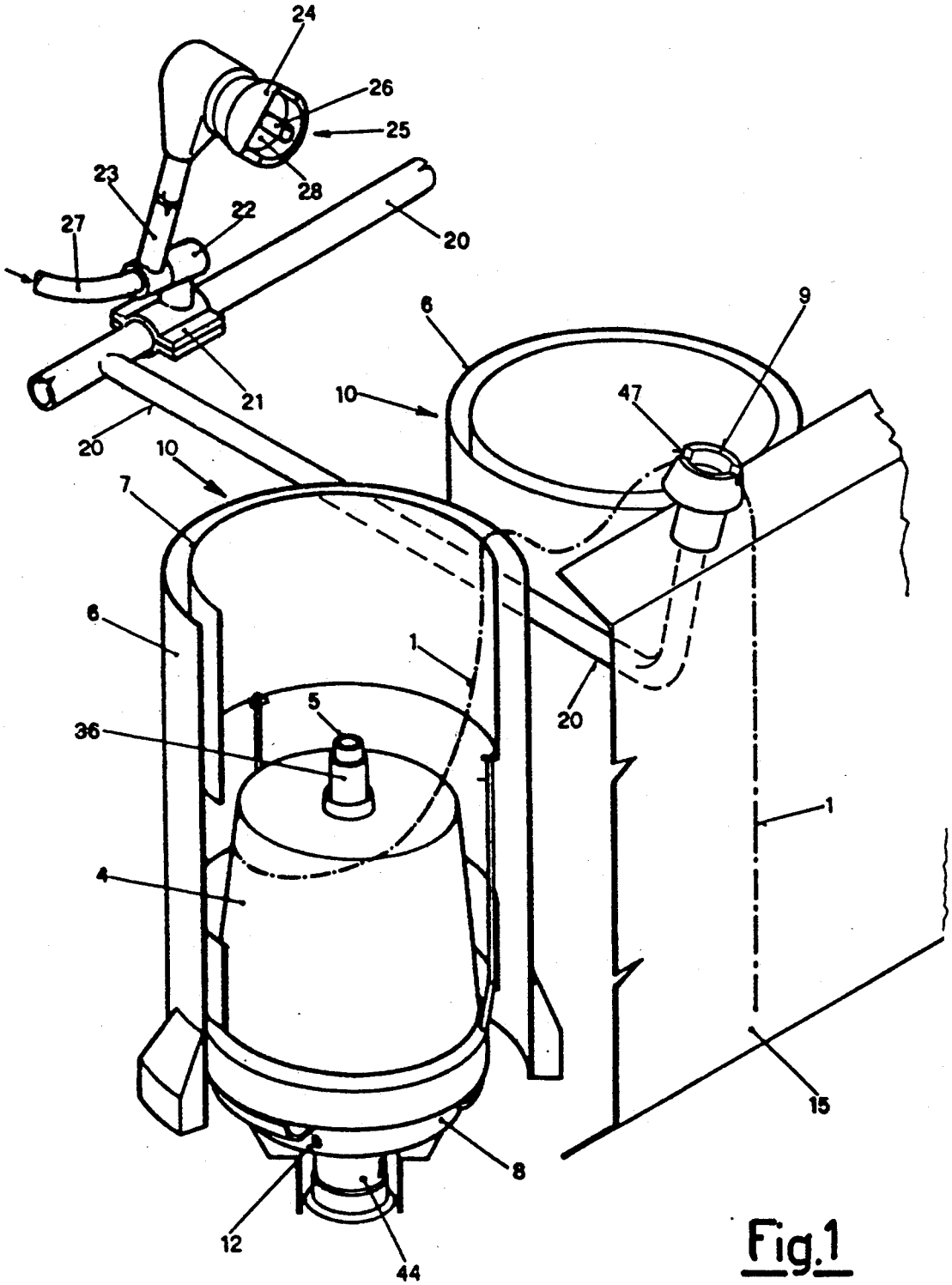
FIG. 1 is a partly sectional axonometric schematic front view of a double hollow mandrel twisting spindle with a frusto-conical bobbin mounted on the lower hollow mandrel housed in the twister spindle basket, said figure showing a head connected to a compressed air source and positioned above the twister spindle, and a compressed air jet injector fixed to the front frame of the twisting spindles.

In the figures, equal parts or parts of equal or equivalent function carry the same reference numerals. Although the method described hereinafter refers to frusto-conical bobbins, it is adaptable to bobbins of cylindrical or any other shape.

For the purpose of overall clarity, those parts not necessary for understanding the invention are omitted from the figures, in that they are already known and because they are not concerned in the operation of the present invention.

In the accompanying drawings: 1 is the initial yarn portion unwound from the underlying bobbin 4, which has already been positioned on the lower hollow mandrel 40 in the spindle basket 7. The end of said initial yarn portion 1 is brought to the outside of the circular casing 6 of the twisting spindle 10 in order to place it in a transverse position in the slot 47 of the compressed air jet injector 9, this latter being rigidly fixed to the front frame 15 of the aligned spindles 10, of which one follows another; 3 is the initial yarn portion unwound from the feed bobbin 2; 5 is the upper end of the hollow mandrel 40, i.e. the lower unwinding head, through the central bore 29 of which the yarns unwound from the feed bobbins 4 and 2 enter and slide to form the twisted yarn; 8 is a yarn accumulator disc of known type on the spindle 10; 12 is the duct through which the yarns 1 and 3 leave the disc 8; 11 is the upper end of the hollow mandrel 14, known as the upper unwinding head, through the central bore 19 of which the yarn 3 slides during the twisting process; 15 is the front frame of the twisting spindles 10, which are positioned one after the other to form the entire face of the twister; 16 and 18 are the conical tubes of the feed bobbins, said tubes centering the bobbins about the respective hollow mandrels; 20 is a tubular element which supports the head 25 and branches the compressed air stream to the injector 9 from the hose 27 which is advantageously connected to the compressed air system of the factory or machine; 26 is an injection nozzle fed with compressed air via the tubular element portion 23, which can be rotated via the joint 22 fixed by the bracket 21 to the element 20; 13 is a plate or disc fixed advantageously to the upper hollow mandrel 14, said plate 13 as is well known to the expert of the art separating the two feed bobbins 2 and 4 when both are inserted one above the other in the spindle basket 10; 24 is an angular surface portion which enables the initial wound yarn portion 3 to enter and slide through the bore 19 of the hollow mandrel during the pneumatic threading operation; 28 is the thrusting surface portion of the head 25 which presses against the upper end 11 of the hollow mandrel 14 to push the lower resting seat 33 of the yarn braking device 30 downwards; 44 is the pulley which rotates the known rotating part of the spindle 10. Said pulley 44 is normally rotated by a belt as is well known in the art; 30 is the expansion yarn braking device for controlling the yarn tension within the spindle. In this case the object shown in the figure is an expansion capsule, already known in the art, consisting of two cylindrical elements 32 and 34 positioned axially and held in their rest position pressing against the seats 31 and 33 by the elastic force of a helical spring 35 housed advantageously within its interior; 36 is a sleeve enclosing the lower hollow mandrel 40, which sleeve 36 can slide downwards and is fixed as one piece to a hollow pin 37 which defines in its cavity the lower support seat 33 for the cylindrical element 34 of the yarn braking device 30; 38 is a helical spring housed in the cavity of the fixed bush 39, this latter supported by the fixed tubular element 41 of the spindle 10. Said helical spring 38 exerts a continuous upwards thrust on the lower surface of the hollow pin 37; 42 is the end bush of the upper hollow mandrel 14. Said bush 42 is fixed as a single piece to the lower end of the hollow mandrel 14 and in moving axially downwards it makes contact with the top of the sleeve 36, causing it to move axially downwards; 46 is the duct which conveys compressed air into the injection nozzle 26 when the duct 46 is moved upwards to connect it to the pressure region 45, compressed air always being present in this latter region; 43 is the permanent magnet inserted into the wall 36 surrounding the lower hollow mandrel 40, said permanent magnet 43 moving axially downwards to lie in a position in front of the yarn braking device 30; 50 is the duct which conveys compressed air to the injector 9 when the duct 50 is moved downwards to connect it to the pressure region 49, compressed air being always present in this latter region, fed by the tubular element 20. Said downward movement coincides with the movement of the element 48, which descends by the thrust action of the lower surface of the bush 42.

The method of the present invention will now be described with reference to the figures of the accompanying drawings, which show a configuration simple to understand both constructionally and operationally.

It will be assumed that the spindle 10 is fed with frusto-conical feed bobbins 2 and 4 to provide yarns 1 and 3 which are to form the twisted yarn.

Figure 3:
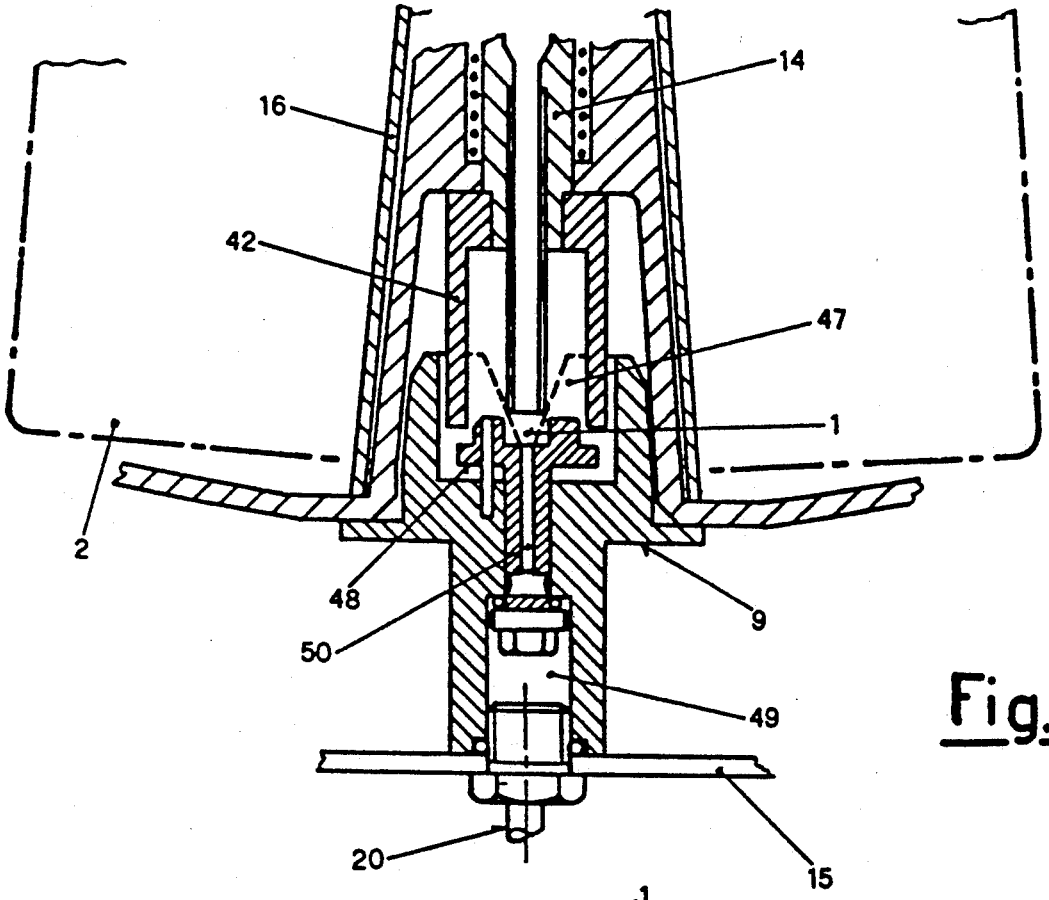
FIG. 3 is a schematic axial section through the resting end of the upper hollow mandrel and lower bobbin support disc when positioned on the compressed air jet injector, while the jet of said injector remains closed.
Figure 4:
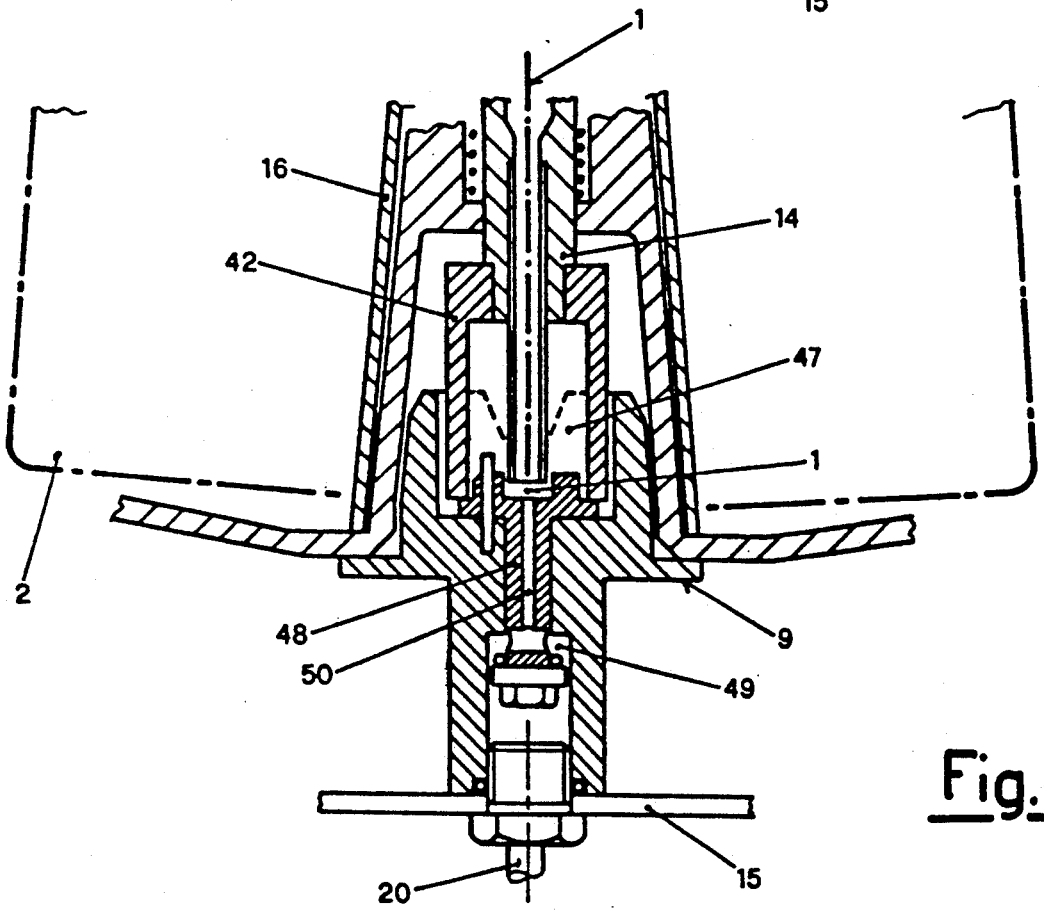
FIG. 4 is a schematic partial axial section analogous to FIG. 3 at the moment in which the downward thrust of the upper hollow mandrel has opened the injector nozzle, the action of which drags the yarn end of the bobbin mounted on the lower hollow mandrel upwards through the central bore of the upper hollow mandrel.

The bobbin 4 is inserted into the basket 7 so that it is housed about the lower hollow mandrel 40 of the spindle. Simultaneously, or beforehand, an initial portion of its yarn 1 of sufficient length to allow it to be inserted in the slot 47 is unwound and allowed to hang by a certain length from the injector 9 (see FIG. 1). The feed bobbin 2 is then taken from any store and is firstly mounted about the hollow mandrel 14 to rest on the plate 13, after which having unwound its initial portion of wound yarn 3 it is mounted on the injector 9 (see FIG. 3). The service operator presses the hollow mandrel 14 downwards so that the bush 42 presses against and moves the element 48 in order to connect the duct 50 to the pressure region 49 (see FIG. 4).

Figure 2:
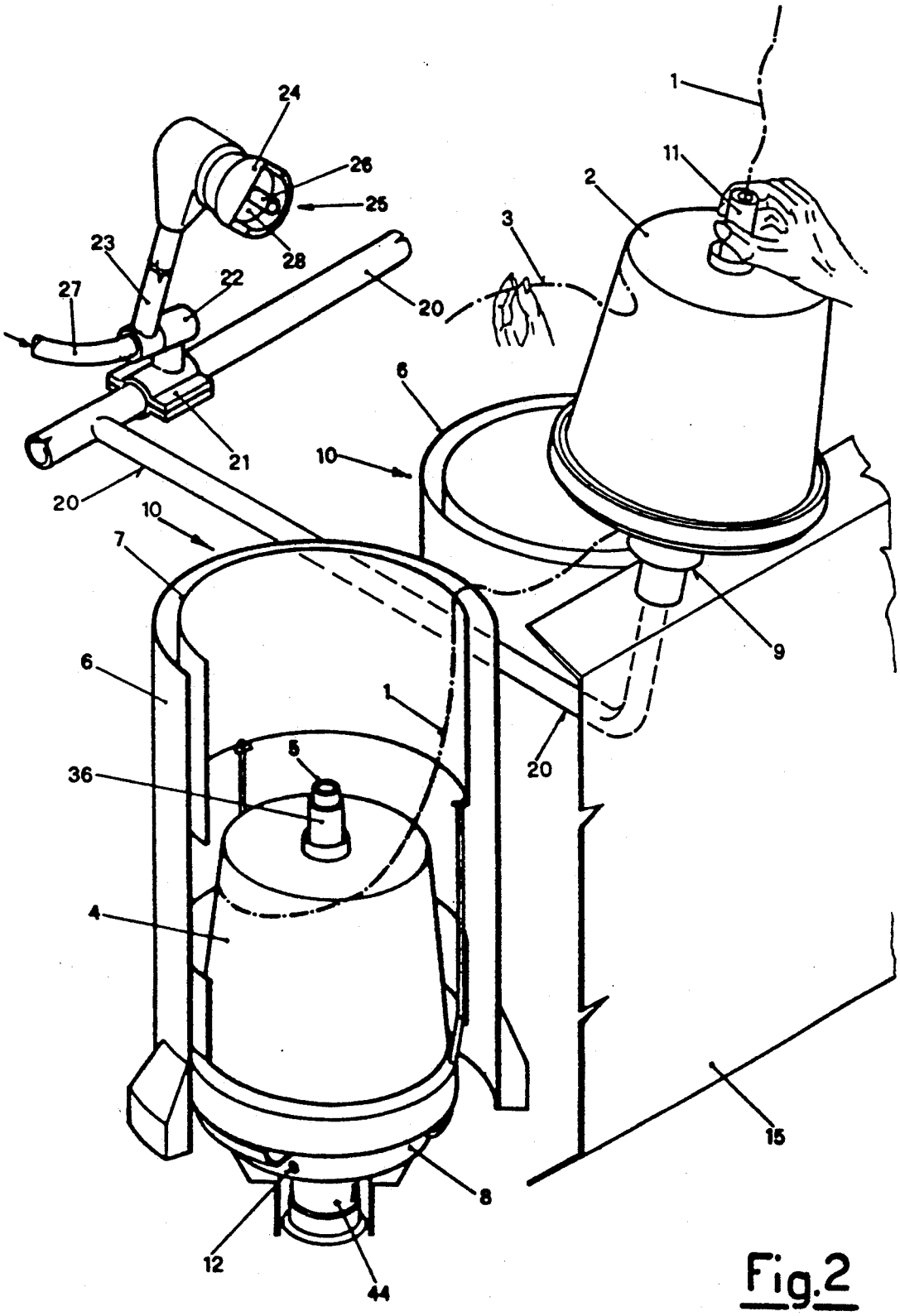
FIG. 2 is an axonometric perspective schematic view of that shown in FIG. 1 at the moment in which the service operator is pressing with a downward thrust the end of the upper hollow mandrel on which there is mounted a frusto-conical bobbin which rests via the lower disc on the compressed air jet injector, the nozzle of which, already opened by said thrust, has already dragged out of the mouth of the bore through the upper hollow mandrel the yarn end from the bobbin mounted on the lower hollow mandrel, said figure also showing the hand of the operator which has unwound the initial portion of yarn from the bobbin positioned on said injector.

The injector 9, traversed by an energetic compressed air stream, forces the yarn 1 out of the upper end 11 of the hollow mandrel 14 (see FIG. 2). The bobbin 2 is now placed in the spindle basket 7 together with the hollow mandrel 14 and plate 13, while the operator retains the yarn ends 1 and 3.

Figure 5:
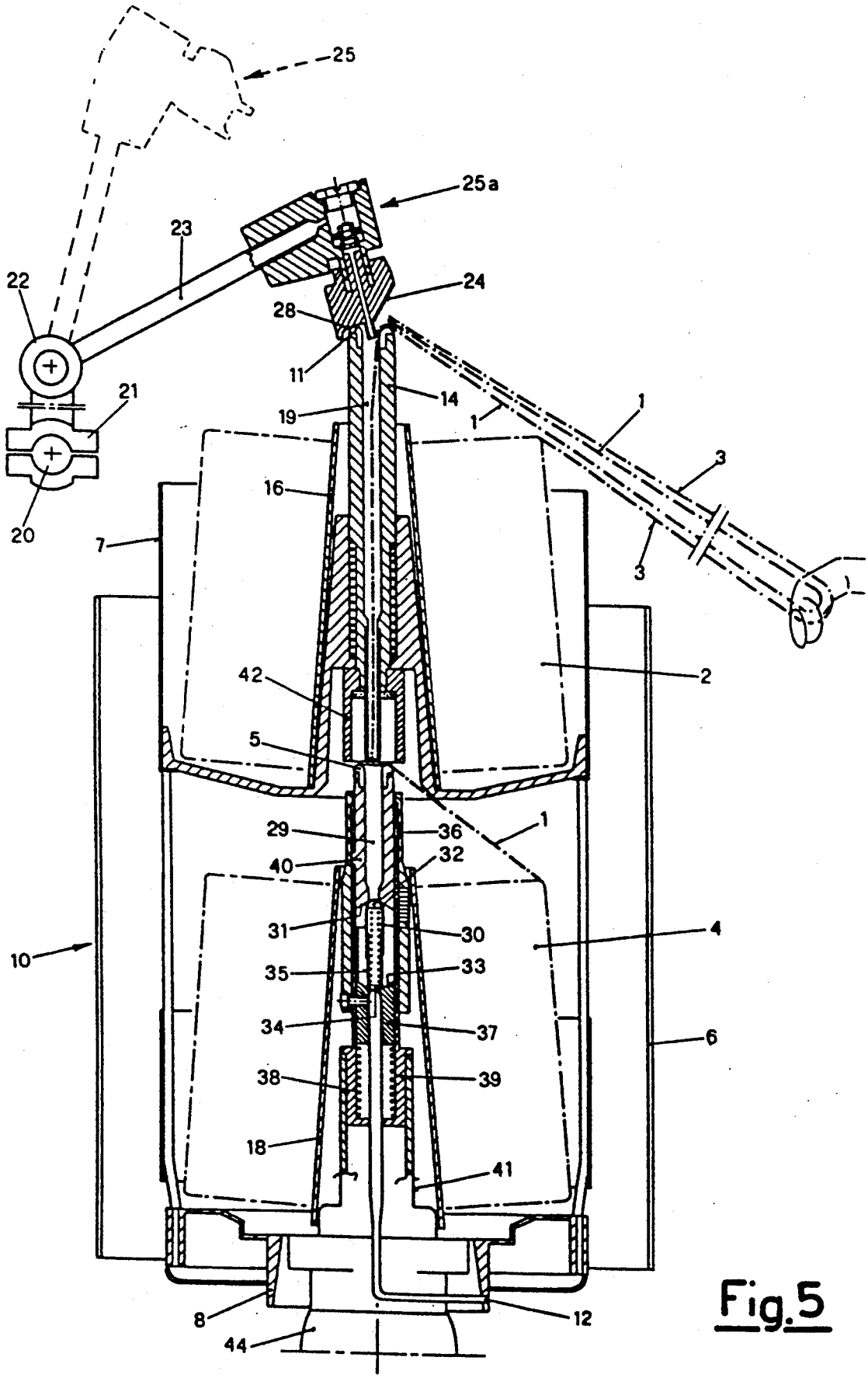
FIG. 5 is a schematic axial section through the double hollow mandrel twisting spindle showing the outlines of the two bobbins one above the other in the spindle basket, and with the initial portions unwound from said bobbins and retained jointly, with a sufficient length emerging from the mouth of the central bore of the upper hollow mandrel, said figure representing the moment in which the head of the compressed air nozzle rests against the mouth of said central bore of the upper hollow mandrel.

The head 25 is then moved into contact with the mouth 11 of the central bore 19 by rotating it into the position **25*a* (see FIG. 5). The head is then pressed downwards. The thrust surface 28, in contact with the end 11, causes the hollow mandrel 14 to move downwards together with the end bush 42. This latter by moving downwards makes contact with the sleeve 36 and pushes it downwards together with the hollow pin 37, the internal cavity of which forms the lower support seat 33. Said seat 33 by moving downwards releases the device 30 which is then attracted sideways by the permanent magnet 43 now positioned in front of said device 30. In this respect, the permanent magnet 43 which is rigid with the sleeve 36 is also moved downwards. At this moment the central bores 19 and 29 of the two hollow mandrels 14 and 40, which are superposed and coaxial, are freed for the passage of the initial yarn portions 1 and 3**.

Figure 9:
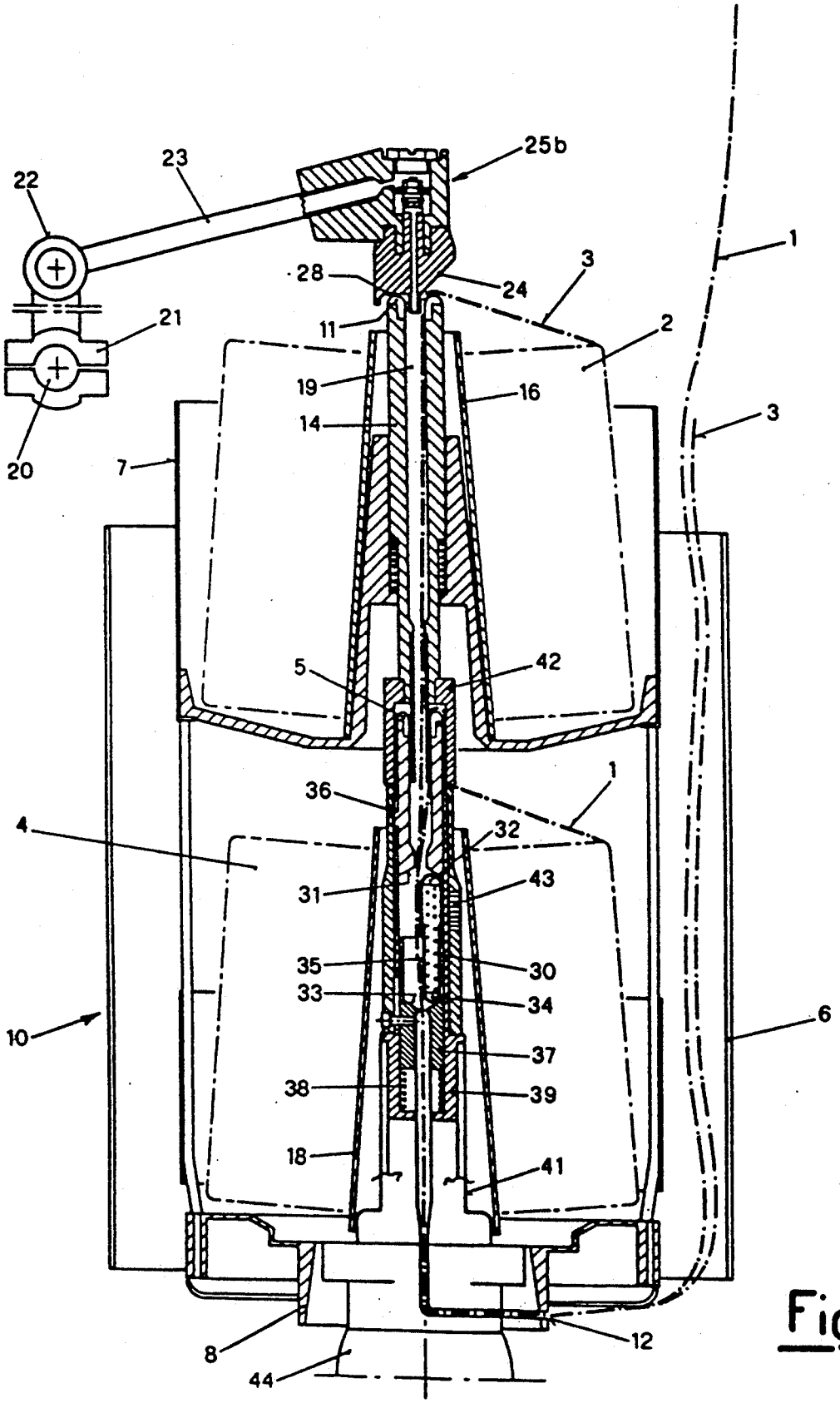
FIG. 9 is a schematic axial section through the double hollow mandrel twisting spindle showing the outlines of the two bobbins one above the other in the spindle basket, and with the initial portions unwound from said bobbins already drawn by the air stream through the central bores of the two coaxial hollow mandrels and through the hole in the accumulator disc to lie at the upper edge of the spindle basket of the twister, said figure also showing the two hollow mandrels thrust downwards one above the other and with the yarn braking device shifted sideways.
Figure 10:
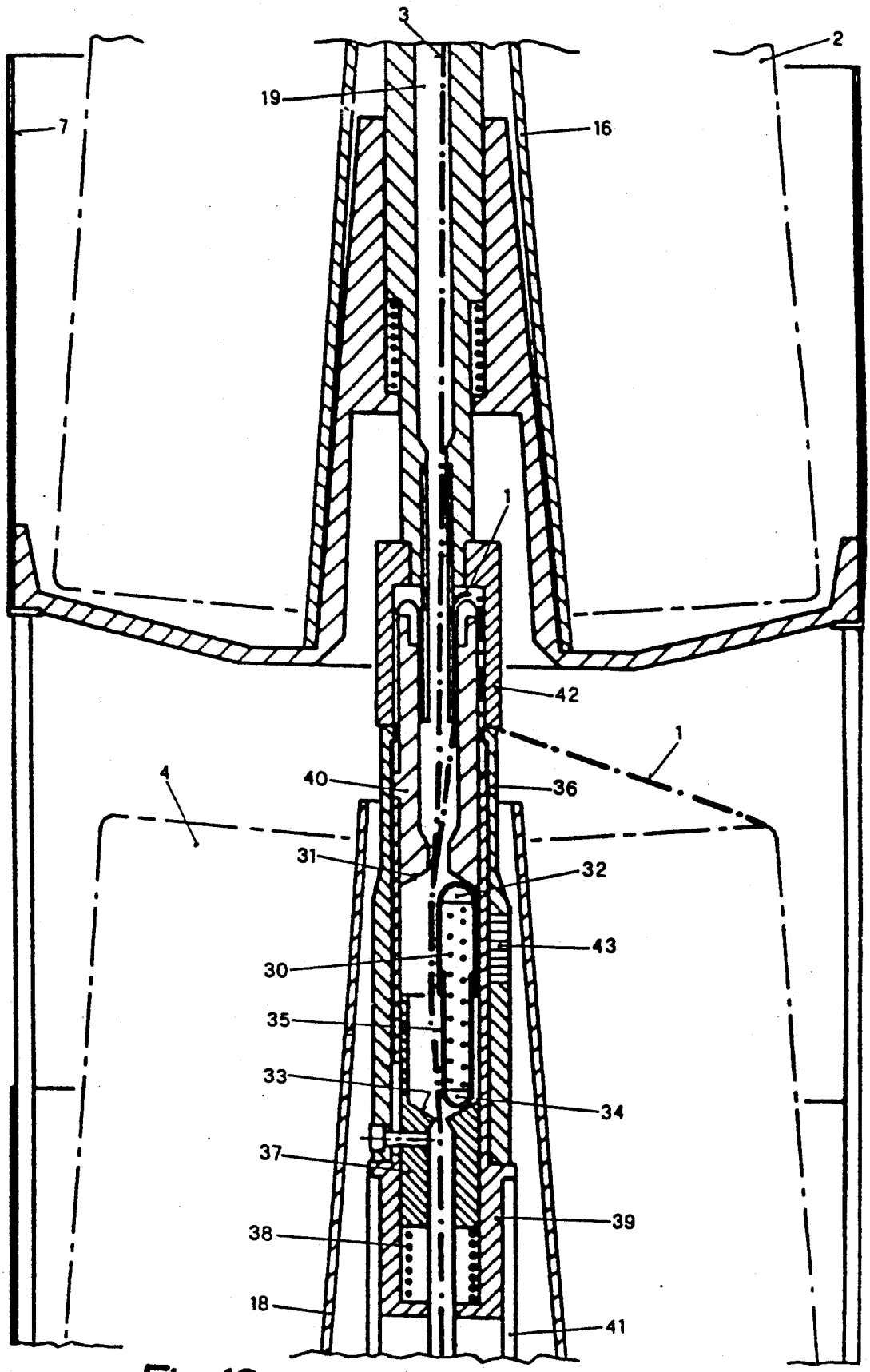
FIG. 10 is a schematic enlarged view of the central portion of the axial section of FIG. 9, showing the considerably spaced-apart support seats for the yarn braking device, which is free to move laterally by the effect of the force of attraction of a permanent magnet associated with the casing of the lower hollow mandrel.

The head 25 assumes the position **25*b* of FIGS. 7 and 9. It is precisely at this moment that the thrusting force of the operator exceeds the force generated by the compressed air on the injection nozzle block 26, so that the duct 46 is moved upwards to communicate with the region 45 in which compressed air is present. This latter passes through said duct 46 and the orifice of the nozzle 26 to create a strong air stream which drags the initial yarn portions 1 and 3 downwards through the central bores 19 and 29 of the two coaxial hollow mandrels so that they emerge from the accumulator disc 8 via the duct 12. The same air stream conveys said initial portions 1 and 3 to the upper edge of the basket 7 of the twister spindle 10 (see FIG. 9**) where they are gripped by the operator, who feeds them to the winding unit (not shown because of known type) in order to commence the known two-for-one twisting operation.

The relative terminology such as "above" and "below" etc. is used in the description and/or claims only to describe the relationship of certain elements relative to others when the twisting spindle is in its normal vertical position, and must not be interpreted as limiting to this precise position.

We claim:

1. A method of threading a double twist spindle for producing double ply yarns, wherein the method employs a compressed air source having a first port and a second port, wherein the spindle has a first and a second yearn feed bobbin and a first and a second hollow shaft respectively, having bores therethrough coaxially arranged for supporting each bobbin, and wherein the method comprises:

a) seizing an initial length of yarn from the first yarn feed bobbin, transversely placing said initial length of yarn on the first port of the compressed air source, and mounting the first yarn feed bobbin on the first hollow shaft;

b) placing the second yarn feed bobbin mounted on the second hollow shaft on the first port of the compressed air source and said placed initial length of yarn;

c) operating the first port of the compressed air source by contacting the second hollow shaft therewith thereby allowing a jet of air to blow said placed length of yarn through the bore of the second hollow shaft and thereby emerging a sufficient length therefrom;

d) seizing an initial length of yarn from the second yarn feed bobbin substantially corresponding with said emerged sufficient length of yarn and contacting therewith;

e) inserting the second yarn feed bobbin with the second hollow shaft into the spindle on top of the first hollow shaft in coaxial alignment;

f) placing said contacting lengths of yarn across the bore of the second hollow shaft;

g) placing the second port of the compressed air source upon the bore of the second hollow shaft and allowing communication between the bore of the second hollow shaft and the bore of the first hollow shaft by said placement;

h) injecting air from the second port through the bores of the first and second hollow shafts thereby blowing said contacted lengths of yarn through both shafts so that they can be seized to commence producing the double ply yarn.

* * * * *